US006064291A

United States Patent [19]

Urabe et al.

[11] Patent Number: 6,064,291

[45] Date of Patent: May 16, 2000

[54] CONVERTER TRANSFORMER

[75] Inventors: Shiro Urabe; Wataru Tabata, both of Matsusaka, Japan

[73] Assignee: Matsushita Electric Industrial Co., Ltd., Osaka, Japan

[21] Appl. No.: 09/117,617

[22] PCT Filed: Dec. 2, 1997

[86] PCT No.: PCT/JP97/04389

§ 371 Date: Aug. 3, 1998

§ 102(e) Date: Aug. 3, 1998

[87] PCT Pub. No.: WO98/25279

PCT Pub. Date: Jun. 11, 1998

[30] Foreign Application Priority Data

Dec. 2, 1996 [JP] Japan ..... 8/321243

[51] Int. Cl.[7] ..... H01F 27/28

[52] U.S. Cl. ..... 336/222; 336/170; 336/180; 336/185; 336/198; 336/199

[58] Field of Search ..... 336/180, 182, 336/183, 170, 185, 199, 222, 198

[56] References Cited

U.S. PATENT DOCUMENTS

| | | | |
|---|---|---|---|
| 3,054,976 | 9/1962 | Lipshutz | 336/182 |
| 3,652,968 | 3/1972 | Johnston et al. | 336/170 |
| 4,229,786 | 10/1980 | Mitani et al. | 363/126 |
| 4,500,833 | 2/1985 | Napp et al. | 323/359 |
| 4,590,453 | 5/1986 | Weissman | 336/180 |
| 4,635,019 | 1/1987 | Akachi et al. | 336/180 |
| 4,639,706 | 1/1987 | Shimizu | 336/170 |
| 5,530,415 | 6/1996 | Takaya et al. | 336/83 |

FOREIGN PATENT DOCUMENTS

| | | |
|---|---|---|
| 1-153624 | 10/1989 | Japan . |
| 4-181708 | 6/1992 | Japan . |
| 7-10924 | 2/1995 | Japan . |
| 8-298218 | 11/1996 | Japan . |
| 8-330150 | 12/1996 | Japan . |
| 9-35948 | 2/1997 | Japan . |
| 9-293613 | 11/1997 | Japan . |

OTHER PUBLICATIONS

Japanese language search report for Int'l Appln No. PCT/JP97/04389 dated Mar. 10, 1998.

Form PCT/ISA/210.

*Primary Examiner*—Michael L. Gellner
*Assistant Examiner*—Tuyen T. Nguyen
*Attorney, Agent, or Firm*—Ratner & Prestia

[57] ABSTRACT

The present invention provides a small, light-weight converter transformer of high efficiency which has an excellent noise characteristic, a high coupling and good output voltage characteristic, low temperature-rise and a high reliability, for use in a switching power supply to be built in an electronic appliance. It has been structured by an inner coil bobbin (28) and an outer coil bobbin (29) provided respectively with three winding grooves (30*a*–30*c*) and (30*d*–30*f*); a primary winding (21) which is split into three split windings (21*a*, 21*b*, 21*c*) are wound around in winding grooves (30*b*, 30*d*, 30*f*), respectively, and connected in parallel; while secondary windings (23, 24) which are split into two split windings (23*a*, 23*b*) and (24*a*, 24*b*), respectively, for supplying to major output load are wound around in winding grooves (30*a*, 30*e*), and connected in parallel; secondary windings (25, 26, 27) are wound around in winding groove (30*c*); primary sub-winding (22) is wound around in winding groove (30*b*) which has been wound around with split winding (21*a*) of primary winding; and a magnetic core (31) made of a ferrite core is assembled to.

9 Claims, 7 Drawing Sheets

CONVERTER TRANSFORMER

THIS APPLICATION IS A U.S. NATIONAL PHASE APPLICATION OF PCT INTERNATIONAL APPLICATION PCT/JP97/04389.

FIELD OF THE INVENTION

The present invention relates to a converter transformer for the switching power supply to be built in color television receivers, various display devices, video tape recorders and such other electronic appliances.

BACKGROUND OF THE INVENTION

The switching power supplies to be built in electronic appliances have been required to have a good noise characteristic, a high coupling for yielding a good output voltage characteristic, a low temperature-rise property and a high reliability, in addition to be compact, light in weight and efficient. A new technology has been requested for developing a converter transformer meeting the above requirements.

An example of conventional converter transformer is shown in FIG. 7 and FIG. 8, and other example in FIG. 9 and FIG. 10. FIG. 7 shows a cross sectional view cut into half, FIG. 8 is a connection diagram of windings. FIG. 9 shows a cross sectional view of other exemplary conventional converter transformer cut into half, FIG. 10 is a connection diagram of windings of the converter transformer.

In FIG. 7 and FIG. 8, a converter transformer comprises a inputting winding 1 (hereinafter referred to as primary winding) formed with split windings 1*a* and 1*b* for inputting a power supply, and output windings 3, 4, 5, 6, 7 (hereinafter referred to as secondary winding) for supplying electricity to load in the secondary side. The secondary windings 3 and 4 are main secondary windings for supplying major power to load in the secondary side, while the secondary windings 5, 6 and 7 are auxiliary secondary windings for supplying minor power to load in the secondary side. Contained further in the converter transformer includes, an output winding 2 (hereinafter referred to as primary sub-winding) for supplying electricity to a control IC in the primary side, a coil bobbin 8, an insulating material 11 provided between windings, and a magnetic core 10 made of a ferrite core.

A conventional converter transformer of this category is assembled with the split winding 1*a* of primary winding 1, the secondary windings 3–7, the split winding 1*b* and the primary sub-winding 2, each wound in the order around coil bobbin 8 with the insulating material 11 of 25 $\mu$m or 50 $\mu$m thick polyethylene terephtalate sticking tape in between the windings, and the magnetic core 10. The secondary windings 3, 4, 5, 6 and 7 are normally disposed between the split winding 1*a* and the split winding 1*b*, and the split winding 1*a* and the split winding 1*b* are connected in series.

In the above described conventional structure, a large encountering area may be provided between primary winding 1 and secondary windings 3–7, because each winding can share a large width; furthermore, the encountering distance between primary winding 1 and secondary windings 3–7 can be made very small as the insulation between windings is made with a thin film. As a result, the coupling between primary winding 1 and respective secondary windings 3, 4, 5, 6 and 7 may be raised to quite a high level, bringing about a high conversion efficiency with low temperature rise of a converter transformer.

Drawback with the conventional converter transformer includes that when the major output load, which is being supplied from main secondary windings 3 and 4, is varied the output voltage of auxiliary secondary windings 5, 6 and 7 makes a substantial fluctuation because of the high coupling with primary winding 1.

Further, the position of winding is easily displaced and the coupling is quite high in the conventional constitution, therefore a slight displacement of winding produces a substantial change in coupling, and shift in the output voltage. For example, if a protection circuit for overvoltage detection is contained in the output of primary sub-winding 2 the protection circuit readily makes an erroneous operation, because of the above described change in coupling.

Furthermore, there is a large stray capacitance existing between primary winding 1 and the whole secondary windings 3–7, and the impedance is small; as a result, high frequency noise component may be easily transmitted to, and the noise characteristic is unfavorable.

Now in the following, the other exemplary conventional converter transformer is described referring to FIG. 9 and FIG. 10. An identical portion as in the earlier described conventional example is represented by putting the same symbol in FIG. 9 and FIG. 10. The conventional converter transformer is assembled with a primary winding 1 and secondary windings 3, 4, 5, 6 and 7. The secondary windings 3 and 4 are main secondary winding for supplying to major output load, the secondary windings 5, 6 and 7 are auxiliary secondary winding for supplying to minor output load. Contained further in the converter transformer are a primary sub-winding 2, a coil bobbin 8*a*, and a magnetic core 10 made of a ferrite core.

A conventional converter transformer of this category is assembled with a primary winding 1 and a primary sub-winding 2 wound around in a winding groove 9b located in substantially the middle among a plurality of winding grooves 9*a*, 9*b*, 9*c*, 9*d* in coil bobbin 8*a*; secondary windings 3 and 4 for supplying to major output load, each has been split into 3*a*, 3*b* and 4*a*, 4*b* and wound around winding groove 9*a*, 9*c*, respectively, and connected in parallel; secondary windings 5, 6 and 7 wound around in a winding groove 9*d* positioned further outside for supplying to minor output load; and a magnetic core 10.

In the above described conventional structure, primary winding 1 and primary sub-winding 2 are wound around in the winding groove 9*b* located in substantially the middle of coil bobbin 8*a*; secondary windings 3 and 4 for supplying to major output load, each split into 3*a*, 3*b* and 4*a*, 4*b* are wound around groove 9*a*, 9*c*, respectively, and connected in parallel; and secondary windings 5–7 are wound around in a groove 9*d* positioned further outside for supplying to minor output load. As a result, the encountering distance between primary winding 1 and secondary windings 5–7 for supplying to minor output is large, and the encountering area is small. Therefore, the coupling may be lowered, and the fluctuation in output voltage of auxiliary secondary windings 5–7 may be suppressed even when the major output load, which is being supplied from main secondary windings 3 and 4, is varied.

Further, because of a structure in which the displacement of winding is hard to occur the shift of coupling is small, so is the output voltage. Therefore, even if, for example, a protection circuit for overvoltage detection is contained in the primary sub-winding 2, erroneous operation of the protection circuit seldom takes place because the voltage fluctuation due to shift in the coupling is small.

Furthermore, as the stray capacitance between primary winding 1 and the whole secondary windings 3–7 is small, the impedance can be made higher, the high frequency noise component is hard to be transmitted to the improvement of noise characteristic.

On the other hand, as the coupling between primary winding 1 and secondary windings 3 and 4 for supplying to major output load is low, the conversion efficiency deteriorates and the temperature rise goes high in the conventional converter transformer.

The present invention provides a small, compact and highly efficient converter transformer that has a good noise characteristic, a high coupling and a good output voltage characteristic, and a suppressed temperature rise as well as a high reliability.

DISCLOSURE OF THE INVENTION

To address the problem, the invented converter transformer is structured with an inner coil bobbin and an outer coil bobbin both of which having a plurality of winding grooves, each of the bobbins are wound around with both a primary winding and a plurality of secondary windings together, the two coil bobbins are fitted together and then a magnetic core is assembled to. In the converter transformer, a primary winding split into a plurality of windings connected one another in parallel or in series, a secondary winding for supplying to major output load and a secondary winding for supplying to minor output load are wound around in a plurality of winding grooves provided in the inner coil bobbin and the outer coil bobbin so as the primary winding and the secondary winding are disposed alternately and facing one another.

With the above described structure, the encountering area between primary winding and secondary winding for supplying to major output load has been expanded, resulting in an intensified coupling between the primary winding and the secondary winding for supplying to major output load. The efficiency of conversion has thus been improved at a low temperature rise in the invented converter transformer.

BEST MODE FOR CARRYING OUT THE INVENTION (Exemplary Embodiment 1)

Figure 1:
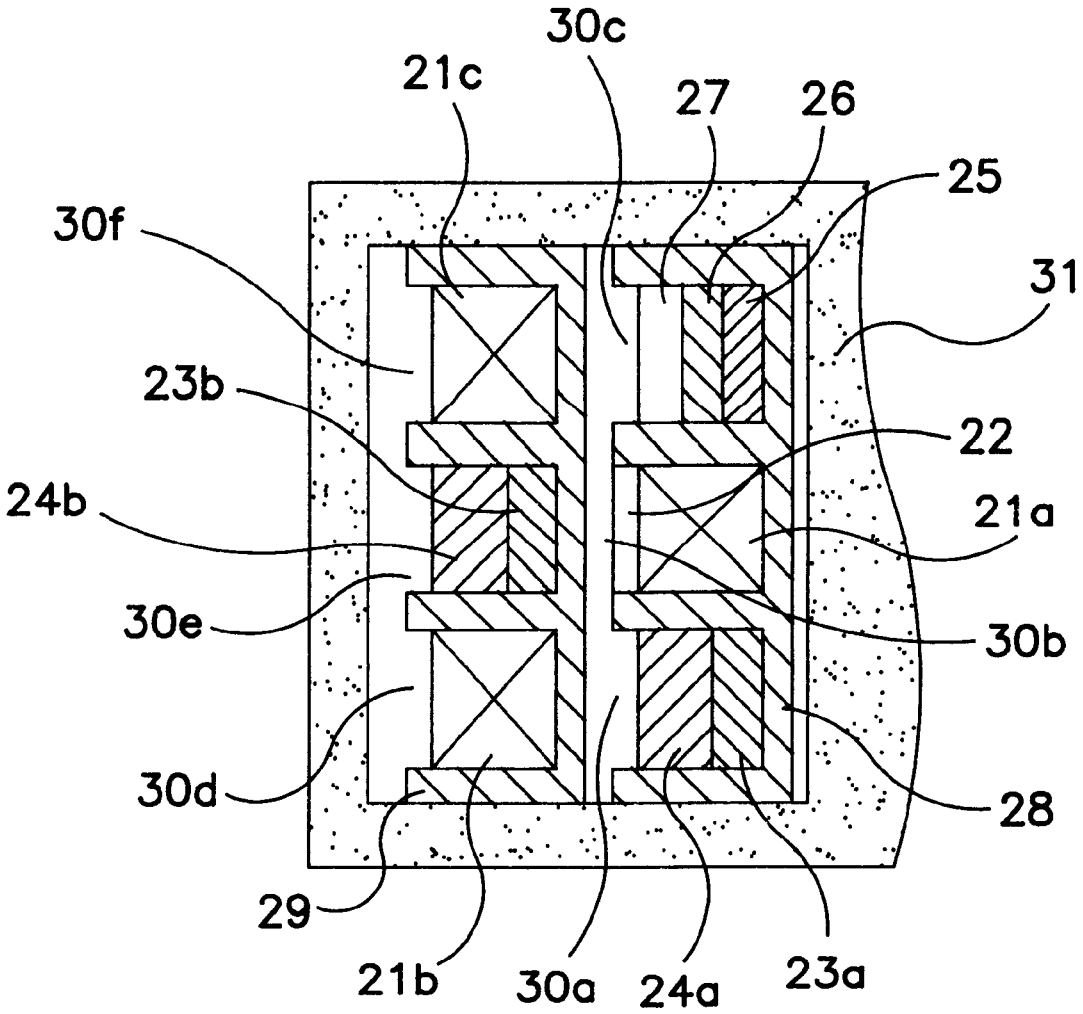
FIG. 1 is a cross sectional view of a half-cut converter transformer in accordance with a first exemplary embodiment of the present invention.
Figure 2:
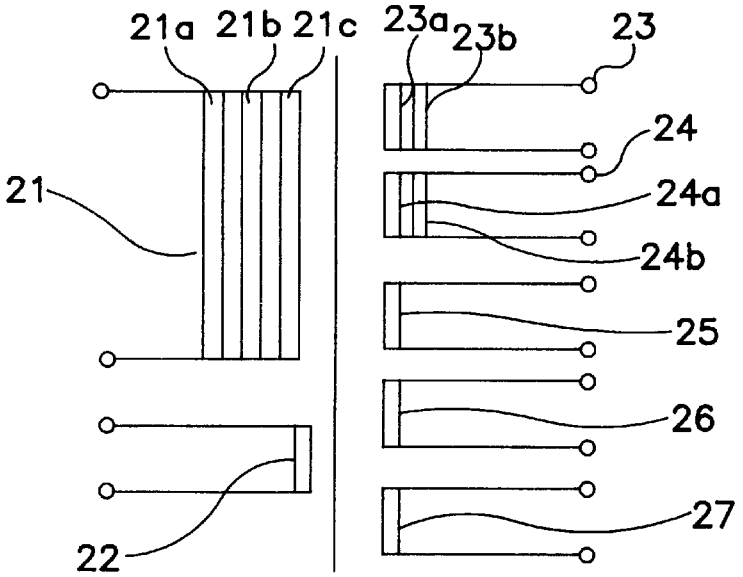
FIG. 2 is a connection diagram of windings of the converter transformer.

A first exemplary embodiment of the present invention is described in the following with reference to FIG. 1 and FIG. 2. Inner coil bobbin 28 and outer coil bobbin 29 are provided respectively with three winding grooves 30*a*–30*c* and 30*d*–30*f*. Primary winding 21 split into three split windings 21*a*, 21*b*, 21*c* are wound around in winding grooves 30*b*, 30*d*, 30*f*, respectively, and are connected in parallel, secondary windings 23 and 24 for supplying to major output load are split respectively into 23*a*, 23*b* and 24*a*, 24*b*, and are wound around in winding grooves 30*a*, 30*e* and are connected in parallel, and secondary windings 25, 26, 27 for supplying to minor output load are wound around in winding groove 30*c*. A magnetic core 31 made of a ferrite core is assembled to. A primary sub-winding 22 is wound around in winding groove 30*b*, in which winding groove the split winding 21*a* has been wound.

Figure 9:
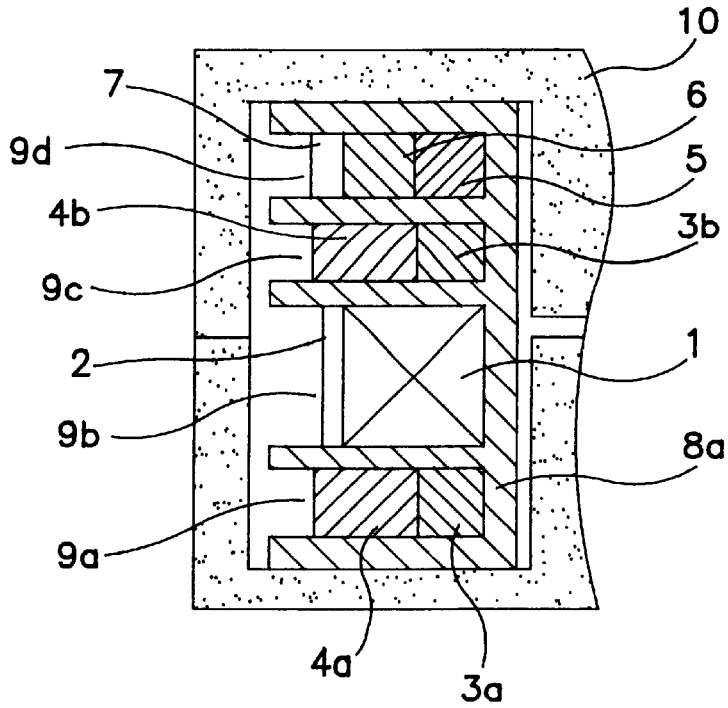
FIG. 9 PRIOR ART
FIG. 9 is a cross sectional view of other half-cut conventional converter transformer.
Figure 10:
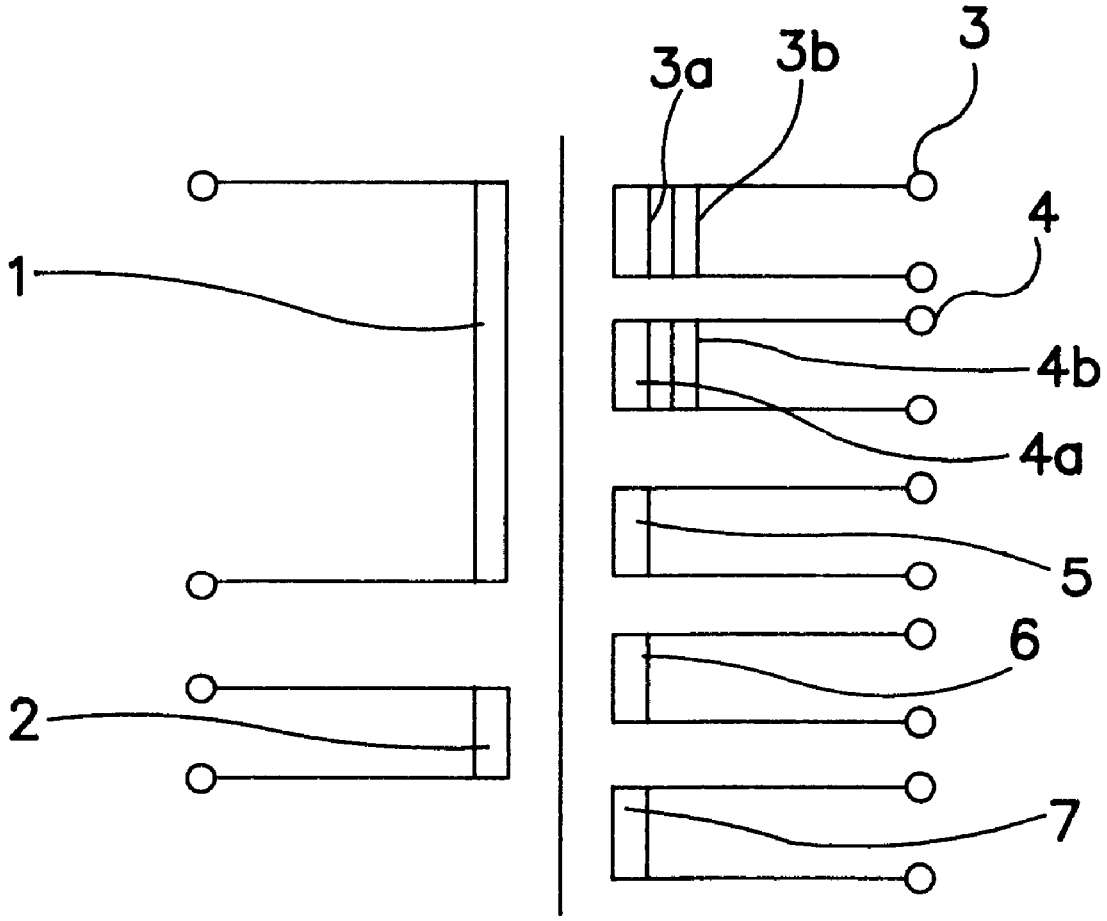
FIG. 10 PRIOR ART
FIG. 10 is a connection diagram of windings of the converter transformer.

In the inner coil bobbin 28 and the outer coil bobbin 29, the split windings 21*a*, 21*b*, 21*c* of primary winding, the split windings 23*a*, 23*b* and 24*a*, 24*b* of secondary winding for supplying to major output load, and the secondary windings 25, 26, 27 for supplying to minor output load are configured alternately and to be facing one another. Such configuration brings about following improvements in the performance over the one with a bobbin having the structure as shown in FIG. 9.

The encountering distance between split windings 21*a*, 21*b*, 21*c* of primary winding and split windings 23*a*, 23*b* and 24*a*, 24*b* of secondary winding for supplying to major output load may be made smaller, and the encountering area may be made larger. Thus the coupling may be raised to quite a high level and the conversion efficiency of a converter transformer may be raised at a suppressed temperature increase.

Because of a structure in which the displacement of winding is difficult to occur, change in the coupling is small, so is fluctuation of the output voltage. Therefore, even if, for example, a protection circuit for overvoltage detection is contained in the output of primary sub-winding 22 a possibility of inviting a problem of erroneous operation in the protection circuit is small, as the voltage fluctuation due to change in coupling is small.

As the stray capacitance between primary winding 21 and the whole secondary windings 23–27 may be reduced a step further, the impedance may be increased and the transmission of high frequency noise component becomes difficult for an improved noise performance.

The electric current flowing in primary winding 21 and secondary windings 23, 24 for supplying to major output load is normally large, as a result, a magnet wire is required to have a large diameter. There have been breakage/deformation problems with inner coil bobbin 28 and/or outer coil bobbin 29. Because in the invented configuration the windings have been split respectively into three split windings 21*a*, 21*b*, 21*c* and two split windings 23*a*, 23*b*, and are connected in parallel, the diameter of magnet wire can be made smaller to the prevention of the above problems. The temperature rise of a converter transformer may also be suppressed in the above configuration.

Further, in a case where there is a high voltage/small current electricity in the primary winding 21 and the secondary windings 23, 24 for supplying to major output load, the respective windings may be split into three split windings connected in series. By so doing, a voltage to be applied on the beginning and the end of a coil wound around in a same winding groove can be lowered to produce a preventive effect against the voltage deterioration in the magnet wire. Thus the life of a converter transformer may be extended.

In the above described configuration, a required characteristic/performance may be implemented through selection of an appropriate arrangement as to which of the winding grooves 30*a*–30*c* of inner coil bobbin 28, winding grooves 30*d*–30*f* of outer coil bobbin 29 the respective windings of three split windings 21*a*–21*c* of primary winding 21, split windings 23*a*, 23*b*, 24*a*, 24*b* of secondary windings 23, 24, and secondary windings 25–27 are to be assigned to.

The range of selection in the characteristics and performance of a converter transformer may be widened by optionally providing any winding to any one of the winding grooves in the inner coil bobbin 28 and in the outer coil bobbin 29.

(Exemplary Embodiment 2)

Figure 3:
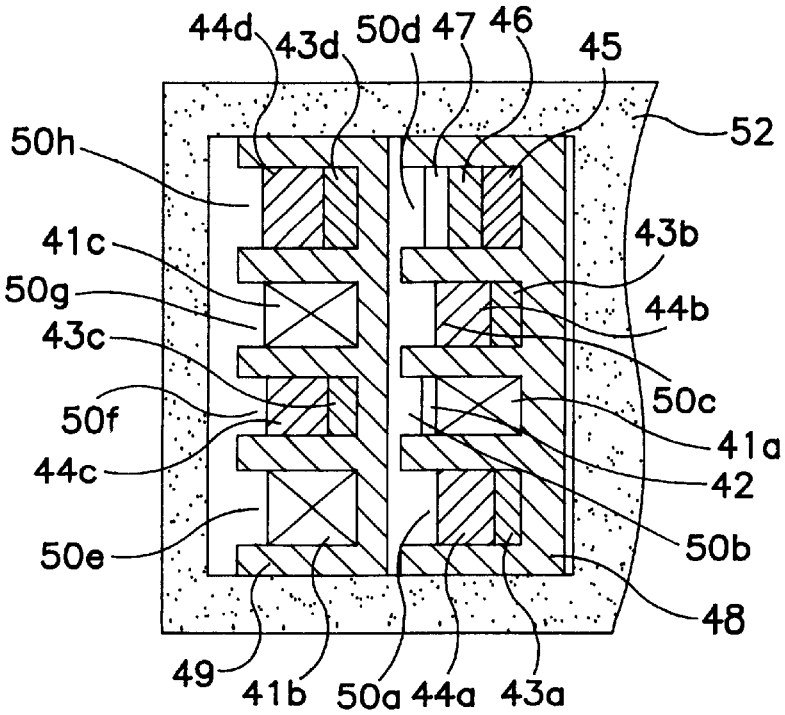
FIG. 3 is a cross sectional view of a half-cut converter transformer in accordance with a second exemplary embodiment of the present invention.
Figure 4:
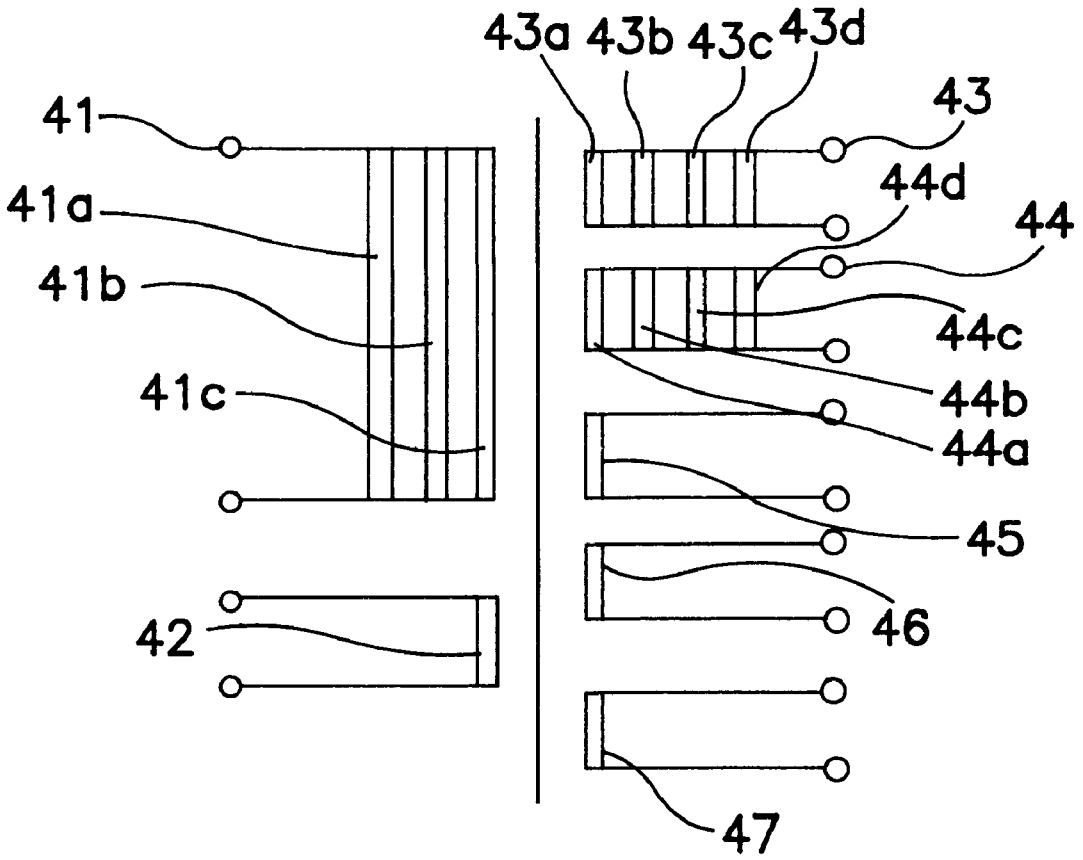
FIG. 4 is a connection diagram of windings of the converter transformer.

A second exemplary embodiment of the present invention is described in the following with reference to FIG. 3 and FIG. 4. Inner coil bobbin 48 and outer coil bobbin 49 are provided respectively with four winding grooves 50*a*–50*d* and 50*e*–50*h*. Primary winding 41 split into three split windings 41*a*, 41*b*, 41*c* are wound around in winding grooves 50*b*, 50*e*, 50*g*, respectively, and are connected in parallel, secondary windings 43 and 44 for supplying to major output load are split respectively into 43*a*, 43*b*, 43*c*, 43*d* and 44*a*, 44*b*, 44*c*, 44*d*, and are wound around in winding grooves 50*a*, 50*c*, 50*f*, 50*h*, and are connected in parallel, and secondary windings 45, 46, 47 for supplying to minor output load are wound around in winding groove 50*d*. A magnetic core 52 made of a ferrite core is assembled to. Primary sub-winding 42 is wound around in winding groove 50*b*, in which groove the split winding 41*a* of primary winding has been wound.

The above configuration brings about additional improvements of performance as described in the following, as compared with a one having the bobbin structure shown in FIG. 1.

The encountering area between split windings 41*a*, 41*b*, 41*c* of primary winding and split windings 43*a*, 43*b*, 43*c*, 43*d* and 44*a*, 44*b*, 44*c*, 44*d* of secondary winding for supplying to major output load may be made larger a step further as a result of the increased number of winding grooves into four in the inner coil bobbin 48 and the outer coil bobbin 49. Thus the coupling may be raised to quite a high level and the conversion efficiency of a converter transformer may be raised, at a suppressed temperature rise.

(Exemplary Embodiment 3)

Figure 5:
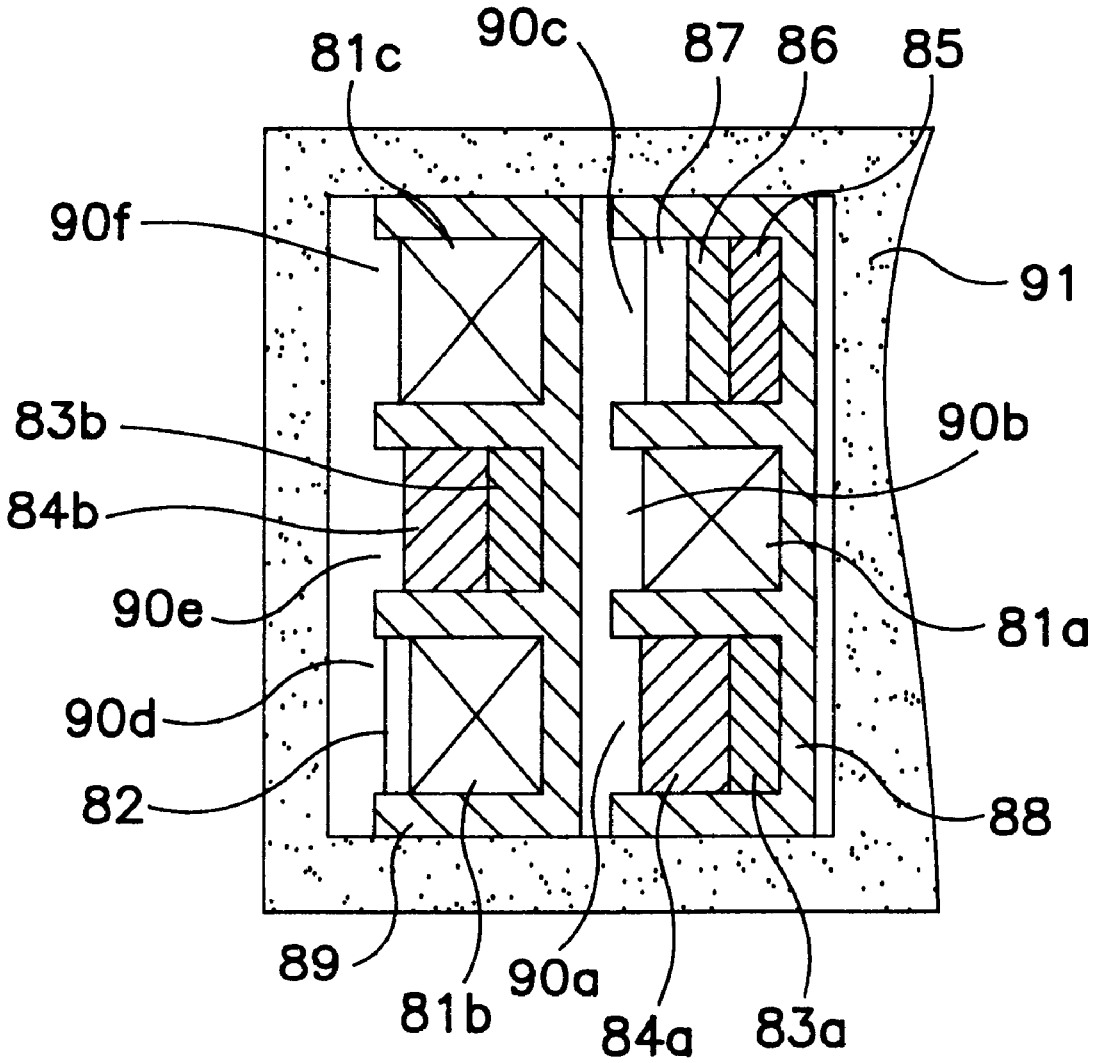
FIG. 5 is a cross sectional view of a half-cut converter transformer in accordance with a third exemplary embodiment of the present invention.
Figure 6:
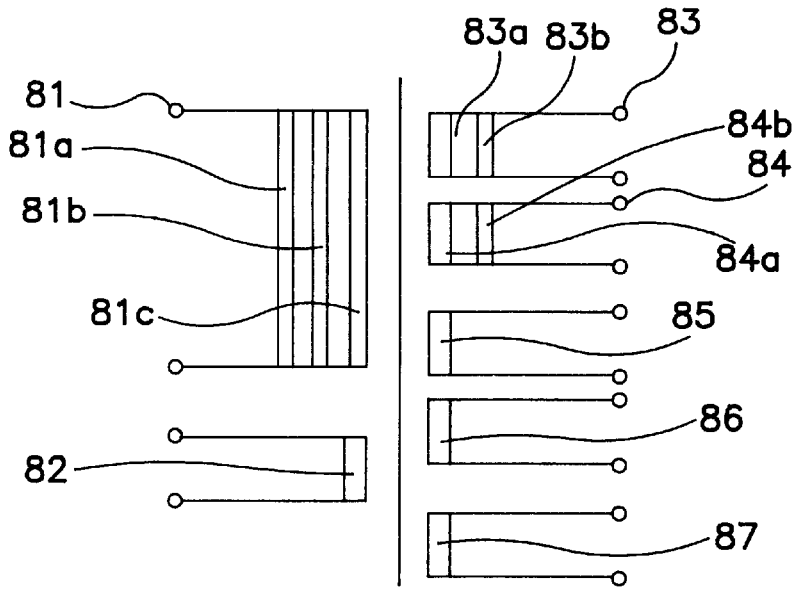
FIG. 6 is a connection diagram of windings of the converter transformer.
Figure 7:
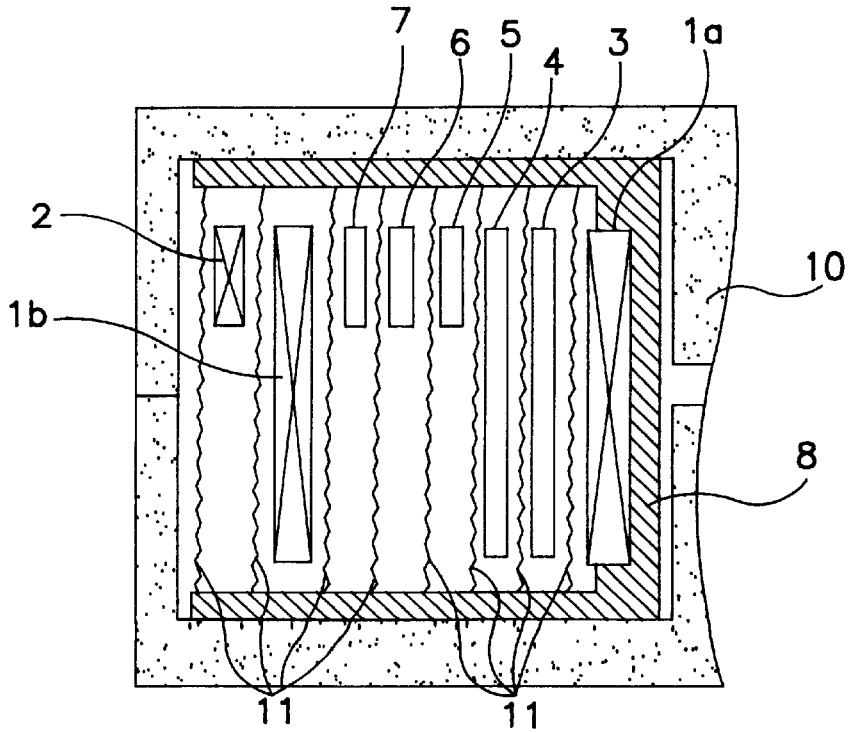
FIG. 7 PRIOR ART
FIG. 7 is a cross sectional view of a half-cut conventional converter transformer.
Figure 8:
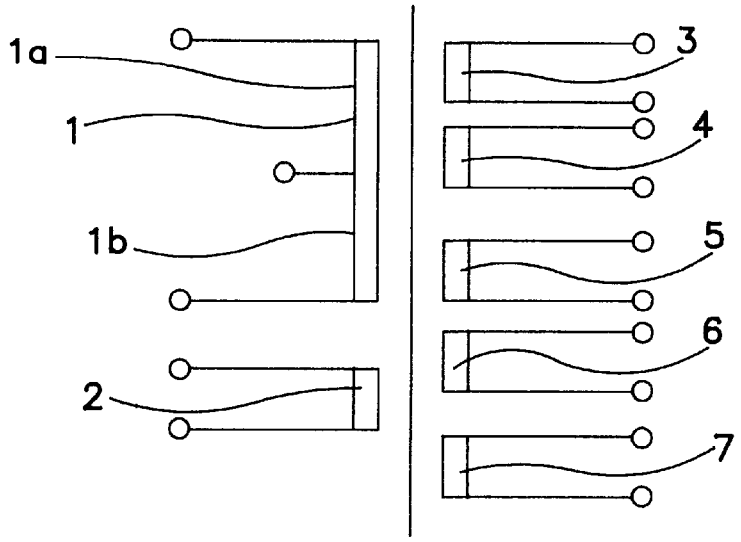
FIG. 8 PRIOR ART
FIG. 8 is a connection diagram of windings of the converter transformer.

A third exemplary embodiment of the present invention is described in the following with reference to FIG. 5 and FIG. 6. Inner coil bobbin 88 and outer coil bobbin 89 are provided respectively with three winding grooves 90*a*–90*c* and 90*d*–90*f*. Primary winding 81 split into three split windings 81*a*, 81*b*, 81*c* are wound around in winding grooves 90*b*, 90*d*, 90*f*, respectively, and are connected in parallel, secondary windings 83 and 84 for supplying to major output load are split respectively into 83*a*, 83*b* and 84*a*, 84*b*, and are wound around in winding grooves 90*a*, 90*e*, and are connected in parallel, and secondary windings 85, 86, 87 for supplying to minor output load are wound around in winding groove 90*c*. A magnetic core 91 made of a ferrite core is assembled to. A primary sub-winding 82 is wound around in winding groove 90*d*, in which groove the split winding 81*b* has been wound.

In the above described configuration, a required characteristic/performance may be implemented by selecting an appropriate arrangement as to which one of the winding grooves 90*a*–90*c* of inner coil bobbin 88, winding grooves 90*d*–90*f* of outer coil bobbin 89 the respective three split windings 81*a*–81*c* of primary winding 81, split windings 83*a*, 83*b*, 84*a*, 84*b* of secondary windings 83, 84, and secondary windings 85–87 are to be assigned to.

The primary winding or the split winding of secondary winding to be wound around in winding groove 90*b* of inner coil bobbin 88 is of already-insulated copper wire.

As an already-insulated copper wire has been used for the split winding 81*a* of primary winding to be wound around in winding groove 90*b* of inner coil bobbin 88, it turns out to be unnecessary to provide a certain specific distance required by safety requirements, from the split winding 81*a* of primary winding to the split windings 83*a*, 84*a* of secondary winding and to the secondary windings 85, 86, 87. As a result, the rim length of inner coil bobbin 88 may be made shorter. The overall size of a converter transformer may be reduced substantially.

Industrial Applicability

In the invented converter transformer, a primary winding and a secondary winding for supplying to major output load split into a plurality of split windings connected in parallel or in series, a secondary winding for supplying to minor output load are wound around in a plurality of winding grooves provided in an inner coil bobbin and in an outer coil bobbin. With this structure, the coupling between primary winding and secondary winding for supplying to major output load may be intensified to a high conversion efficiency, at a suppressed temperature rise.

With the above described structure, displacement of windings is difficult to occur. So the shift of coupling is maintained small, so is the fluctuation of output voltage. Therefore, even if a protection circuit for overvoltage detection e.g. is contained in the output of primary sub-winding, an operation error seldom arises with the protection circuit.

In the above described structure, the stray capacitance between the primary winding and the whole secondary windings is small, so the impedance may be raised. It is difficult for the high frequency noise to be transmitted, and a low noise performance is implementable.

In a case where a secondary winding for supplying to minor output load is wound in a winding groove where the coupling with the primary winding is low, fluctuation of output voltage from the auxiliary secondary winding may be maintained within a narrow range even when major output load, to which the main secondary winding is supplying to, is varied.

In a case where a large electric current is expected in primary winding and secondary winding for supply to major output load, the respective windings may be split into a plurality of parallel-connected windings. Thereby, diameter of the magnet wire may be made smaller. This contributes to eliminate the problems; eliminating deformation/breakage of the inner and outer coil bobbins, for example.

In a case where a high voltage/small current is expected in primary winding and secondary winding for supply to major output load, the respective windings may be split into a plurality of series-connected windings. Thereby, a voltage to be applied on the beginning and the end of a coil wound around in a same winding groove may be lowered for a reduced voltage deterioration of a magnet wire. The life of a converter transformer may be extended.

In a case where a large fluctuation of output load is expected in a winding among the secondary windings for supply to minor output load, the winding may be wound around separately in a winding groove which is different from that of other secondary windings. By so doing, the encountering distance of the winding to other secondary winding becomes large, and the encountering area small; as a result, the coupling is low. Thus, even if output load of the large fluctuation winding is varied, change in output voltage of other secondary winding may be suppressed within a small range.

When an already-insulated copper wire is used for primary winding or secondary winding wound around in a winding groove of inner coil bobbin, a certain specific distance required by safety specifications between the primary winding and the secondary winding in the inner coil bobbin becomes unnecessary. As a result, the size of inner bobbin may be reduced in the rim length, and the whole dimensions of a converter transformer can be made substantially smaller.

As described in the above, the present invention provides a small and light-weight converter transformer featuring high efficiency, excellent noise performance, high coupling and good voltage characteristic, low temperature rise and high reliability, at an inexpensive manufacturing cost.

What is claimed is:

1. A converter transformer comprising:

an inner coil bobbin and an outer bobbin coupled together, each provided with a plurality of winding grooves;

a primary winding is wound around the inner coil bobbin and the outer coil bobbin, and a plurality of secondary windings are wound around the inner coil bobbin and outer coil bobbin; and a magnetic core surrounds the inner and outer coil bobbins, wherein the primary winding comprises a plurality of split windings coupled in parallel or in series, the plurality of secondary windings comprises a main secondary winding adapted for supplying power to a major output load and an auxiliary secondary winding adapted for supplying power to a minor output load, and the split windings of the primary winding and the plurality of secondary windings are wound around the plurality of winding grooves of the inner coil bobbin and the outer coil bobbin, so that the plurality of the winding grooves of the inner and outer coil bobbins alternate between the split windings of the primary winding and the secondary windings, and any split winding of the primary winding in the inner coil bobbin opposes a secondary winding in the outer coil bobbin, and any split winding of the primary winding in the outer coil bobbin opposes a secondary winding in the inner coil bobbin.

2. The converter transformer of claim 1, wherein the number of the winding grooves of the outer coil bobbin is the same as that of the winding grooves of the inner coil bobbin.

3. The converter transformer of claim 1, wherein the number of the winding grooves of the outer coil bobbin is different from that of the winding grooves of the inner coil bobbin.

4. The converter transformer of claim 1, wherein at least one of the plurality of split windings of the primary winding and secondary windings are wound around the plurality of winding grooves of the inner coil bobbin.

5. The converter transformer of claim 1, wherein at least one of the plurality of split windings of the primary winding and the secondary windings are wound around the plurality of winding grooves of the outer coil bobbin.

6. The converter transformer of claim 1, wherein the plurality of split windings of the primary winding and the plurality of secondary windings are wound around the plurality of winding grooves of the inner and outer coil bobbins.

7. The converter transformer of claim 1, wherein the primary winding or the plurality of secondary windings wound around the winding grooves of the inner coil bobbin are made from an insulated copper wire.

8. The converter transformer of claim 1, wherein the main secondary winding comprises a plurality of split windings.

9. The converter transformer of claim 1, wherein the main secondary winding comprises a plurality of split windings coupled in parallel or in series.

* * * * *